US006456201B1

(12) United States Patent
Mioduszewski et al.

(10) Patent No.: US 6,456,201 B1
(45) Date of Patent: Sep. 24, 2002

(54) METHOD AND APPARATUS FOR MEASURING GROUNDWATER LEVELS

(75) Inventors: David Mioduszewski; David A. Fischer, both of Ann Arbor, MI (US); David B. Kaminski, Clayton, CA (US)

(73) Assignee: QED Environmental Systems, Inc., Ann Arbor, MI (US)

( * ) Notice: Subject to any disclaimer, the term of this patent is extended or adjusted under 35 U.S.C. 154(b) by 0 days.

(21) Appl. No.: 09/660,625

(22) Filed: Sep. 13, 2000

(51) Int. Cl.[7] ..... G08B 21/00

(52) U.S. Cl. ..... 340/612; 340/618; 340/620; 73/304 R; 73/290 R; 166/250.03

(58) Field of Search ..... 340/612, 618, 340/620; 73/304 R, 304 C, 290 R, 305–308; 200/190; 166/250.01, 250.03

(56) References Cited

U.S. PATENT DOCUMENTS 6,085,836 A * 7/2000 Burris et al. ..... 166/250.3
6,087,946 A * 7/2000 Menard, Jr. ..... 340/618

OTHER PUBLICATIONS

"User's Guide" published prior to filing date of Sep. 13, 2000.

Paper entitled "Model 6000 Static Water Level Meter"dated Jun. 16, 1992.

"Electronic Programmable Controller Model 400" published prior to filing date of Sep. 13, 2000.

"FC 5000 Flow Cell Meter & Sonde Quickguide" published Oct. 20, 1999.

Information Sheet "Low Flow Ground Water Sampling" issued Jun. 1996 from the Maine Department of Environmental Protection.

EPA Ground Water ISsue Low–Flow (Minimal Drawdown) Ground–Water Sampling Procedures issued Dec. 1995 from U.S. Environmental Protection Agency.

* cited by examiner

*Primary Examiner*—Julie Lieu
(74) *Attorney, Agent, or Firm*—Harness, Dickey & Pierce, PLC

(57) ABSTRACT

A method and apparatus for monitoring the fluid level in a well bore to limit fluid drawdown in the well bore to a maximum set level. The user first determines the static water level in the well bore by lowering a sensor into the well bore. The sensor is configured to sense when it makes contact with water, so that the user can be made aware that the sensor has reached the static water level. The user then lowers the sensor to a maximum desired drawdown level. The sensor is then set to sense when it loses contact with the water. The sensor is then monitored to determine if the fluid had has dropped below the maximum desired drawdown level, and an audible and/or visual alarm alerts the user whenever the maximum desired drawdown level is exceeded.

23 Claims, 4 Drawing Sheets

METHOD AND APPARATUS FOR MEASURING GROUNDWATER LEVELS

BACKGROUND OF THE INVENTION

1. Technical Field

This invention relates to measurement devices for measuring groundwater levels, and more particularly to a measurement device including a sensor that measures a groundwater level and determines when the groundwater level falls below a given threshold.

2. Background Art

Measurement devices are commonly used to measure the water level in well bores. A typical method of monitoring water level drawdown is to lower a sensor into the well bore, attached to a flexible element such as a measuring tape. The sensor senses the conductivity through water and generates a signal when it makes contact with water. That signal is carried through a wire in the tape to an indicator device such as a light or an alarm, such that when the sensor makes contact with the water, the user is informed that the groundwater level has been reached.

A common way to sample groundwater from a well bore is to draw the groundwater out of the ground using a pump. It is often important in sampling groundwater with a pump to avoid pumping the water level in the well bore down to excessive drawdown levels. Otherwise, sample integrity can be compromised. In typical operation, the static water level is first determined using the sensor as above. The user then lowers the sensor to the level of maximum desired drawdown, chosen based on pumping conditions and pumping purpose, and begins pumping. When the water level drops below the maximum desired drawdown level, the sensor no longer senses conductivity and ceases to alert the user that conductivity is detected. The user must then manually adjust pump operation.

One drawback with this approach to monitoring drawdown is that the indicator device must be audibly monitored constantly throughout the pumping process to verify that the water level is continually above the maximum drawdown level. Additionally, the alarm is being emitted virtually continuously, since it is present during the normal pumping operation. It is an object of the present invention to alert the user only when the water level is below the maximum drawdown level, rather than above this level.

Another problem in sampling groundwater is when the water level frequently drops below the maximum drawdown level due to an excessive pumping rate and a lapse in the operator's monitoring of water level and/or control of flow rate. Proper operation requires the operator to make frequent adjustments of the sampling pump in response to frequent observation of water level changes in the well bore. It is therefore another object of the present invention to automate the adjustment of the pump as necessary to prevent the maximum desired drawdown level from being exceeded.

SUMMARY OF THE INVENTION

The above and other objects are provided by a method and apparatus for measuring the groundwater levels in accordance with preferred embodiments of the present invention. The present invention provides a method and apparatus for measuring the level of a fluid, such as water, in a well bore. In a preferred embodiment, a user first determines the static water level in the well bore by lowering a sensor into the well bore. The sensor senses when it makes contact with water, so that the user is made aware when the sensor has reached the static water level. The user then lowers the sensor further to a maximum desired drawdown level. The sensor is then reconfigured to sense when it loses contact with the water. The sensor is then monitored to determine if the fluid has dropped below the maximum drawdown level.

In a preferred embodiment of the present invention, the water level is determined using a sensor attached to a flexible element such as a measuring tape. The tape is marked in feet (or any other desired unit of measurement) such that the user can determine the depth of the sensor in the well bore. The tape includes a wire for carrying an electrical signal from the sensor to an alarm interface including an alarm. The sensor emits a signal when it makes contact with water. In one preferred embodiment, the signal is an electrical signal which is carried via the wire to the alarm interface. In a preferred embodiment, the alarm includes an audible alarm and/or a visible light.

The sensor is lowered into the well bore until the sensor comes in contact with the water at the static water level, at which time it sends a first signal to the alarm indicating to the user that the static water level has been reached. The user then lowers the sensor to the maximum drawdown level. The user then actuates a reverse response switch, which causes the alarm to activate when the sensor is no longer in contact with the water instead of when it is in contact with the water.

Another preferred embodiment of the present invention includes controlling a pump in response to the second signal. The pump is used to draw the water out of the well bore at a first pumping rate. In doing so, the pump can cause the water level to temporarily drop. When the sensor senses that the water level has dropped below the maximum drawdown level, the pumping rate is adjusted to a second pumping rate lower than the first pumping rate. In a preferred embodiment, the user adjusts the pump when the alarm engages, indicating that the water level has dropped below the maximum drawdown level. In another preferred embodiment, the alarm signal is carried by a cable to a pump controller. The pump controller automatically adjusts the pumping rate to the second (i.e. lower) pumping rate in response to the alarm signal indicating that the water level has dropped below the maximum drawdown level.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
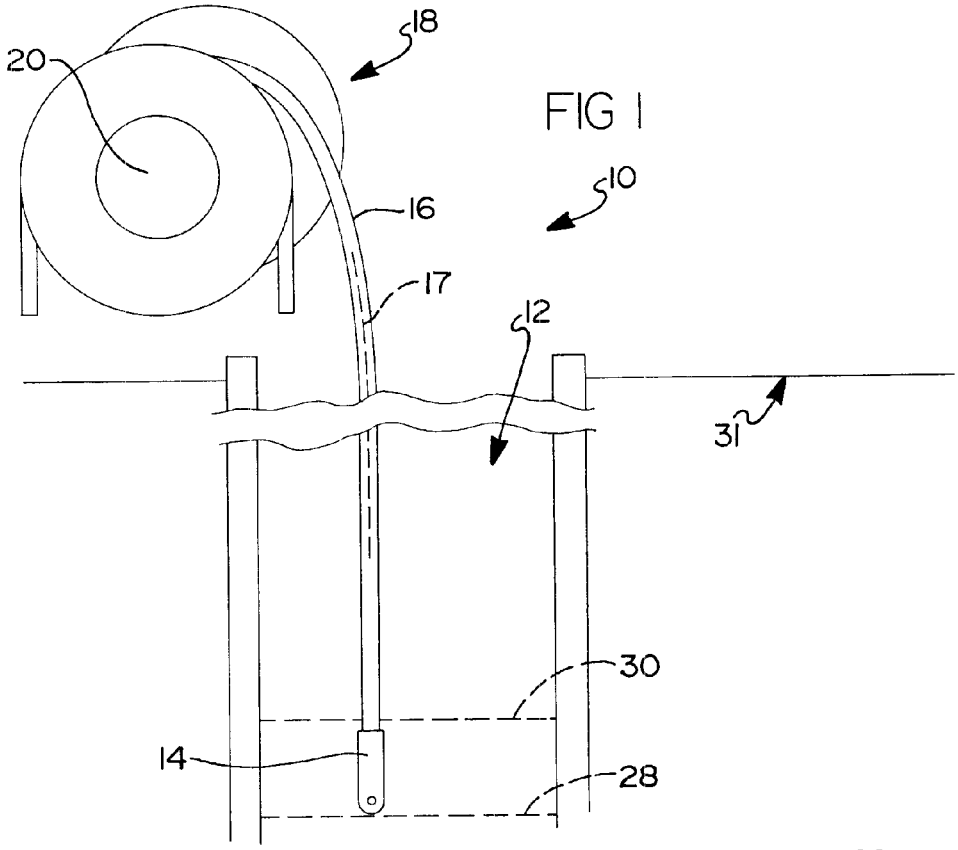
FIG. 1 is a cross-sectional view of a water level sensing apparatus in accordance with a preferred embodiment of the present invention shown sensing a water level in a well bore.
Figure 2:
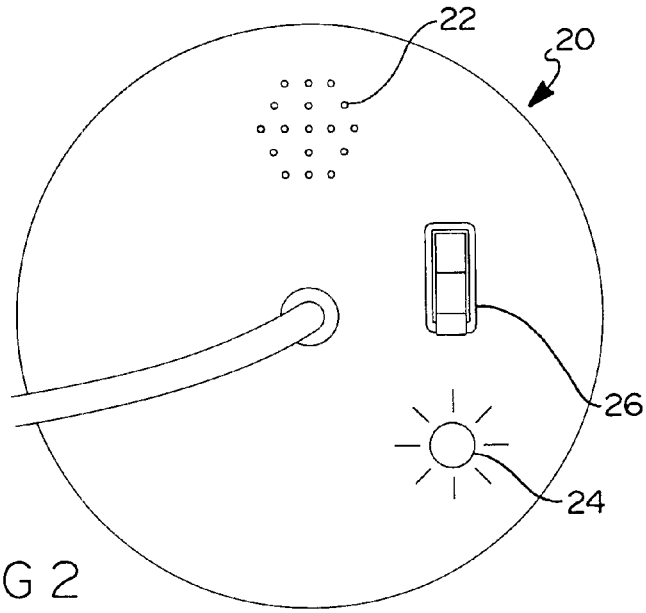
FIG. 2 is an enlarged view of a display of the water level sensing apparatus in accordance with a preferred embodiment of the present invention.

With general reference to FIGS. 1 and 2 of the drawings, there is shown a measurement system 10 for measuring a fluid level in a well bore 12 in accordance with a preferred embodiment of the present invention. The system 10 includes a sensor 14 attached to one end of a flexible element such as a measuring tape 16. Visible on the tape 16 is indicia such as foot markings (or any other suitable units of measurement) to allow a user to determine the depth of the sensor 14 as the sensor 14 is lowered into the well bore 12. The other end of the tape 16 is attached to a reel 18. The tape 16 can be stored by wrapping around the reel 18 the portion of the tape 16 not lowered into the well bore 12. Connected to the sensor 14 is a conductor in the form of a wire 17 that is housed within the tape 16 for carrying a signal from the sensor 14 to a display 20 on the reel 18. With reference to FIG. 2, the display 20 includes a speaker 22 for emitting an audible alarm, a light 24 for emitting a visual alarm, and a "reverse sensor" switch 26.

Figure 3:
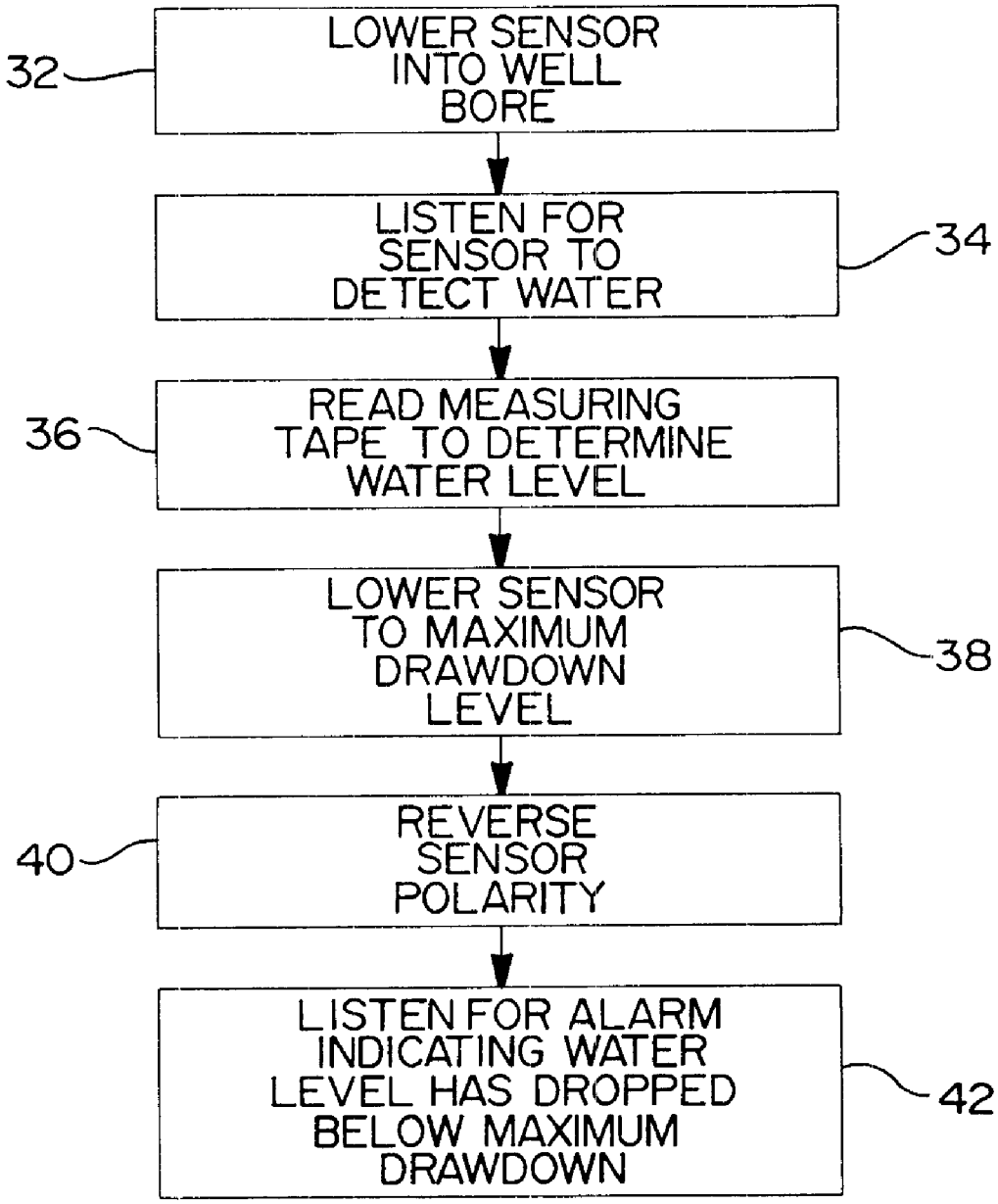
FIG. 3 is a flowchart of a method for sensing the water level in the well bore in accordance with a preferred embodiment of the present invention.

With reference to FIGS. 1 and 3, the system 10 is used to determine when the water level has dropped below a maximum desired drawdown level 28. With specific reference to FIG. 3, the user first determines the static water level 30, below ground level 31 in the well bore 12. To do this, the user lowers the sensor 14 into the well bore 12 by rotating the reel 18, as in step 32. The sensor 14 uses the electric conductivity of the water to detect its presence and generates a water indicating signal when the sensor 14 makes contact with water, as indicated at step 34. Thus, when the sensor 14 is lowered to the point where it reaches the static water level 30, it emits the water indicating signal, which is carried by the wire 17 in the tape 16 to the display 20 on the reel 18. The display 20 is configured such that an audible alarm and/or a visual alarm is emitted by the speaker 22 or light 24, respectively. As in step 34, the user listens or watches for the alarm (i.e., speaker 22 or light 24) to indicate that the static water level 30 has been reached. The user then obtains a measurement of the static water level 30 by reading the measurement printed on the tape 16, as in step 36.

Once the user has determined the static water level 30, the sensor 14 is lowered to the maximum drawdown level 28, as in step 38. Next, the reverse sensor switch 26 is actuated, as in step 40, to reconfigure the system 10 such that the alarm is emitted when the sensor 14 loses contact with the water. In a preferred embodiment of the present invention, this is accomplished by causing the display 20 to interpret the signal such that the alarm is only emitted when the sensor 14 loses contact with the water. For example, when the water drops below the maximum drawdown level 28, the sensor 14 loses contact with the water, and ceases to send a signal to the display 20, which then emits an alarm. Therefore, the user monitors the audio and/or visual alarms 22, 24 to determine when the water level has dropped below the maximum drawdown level 28, as in step 42.

Figure 4:
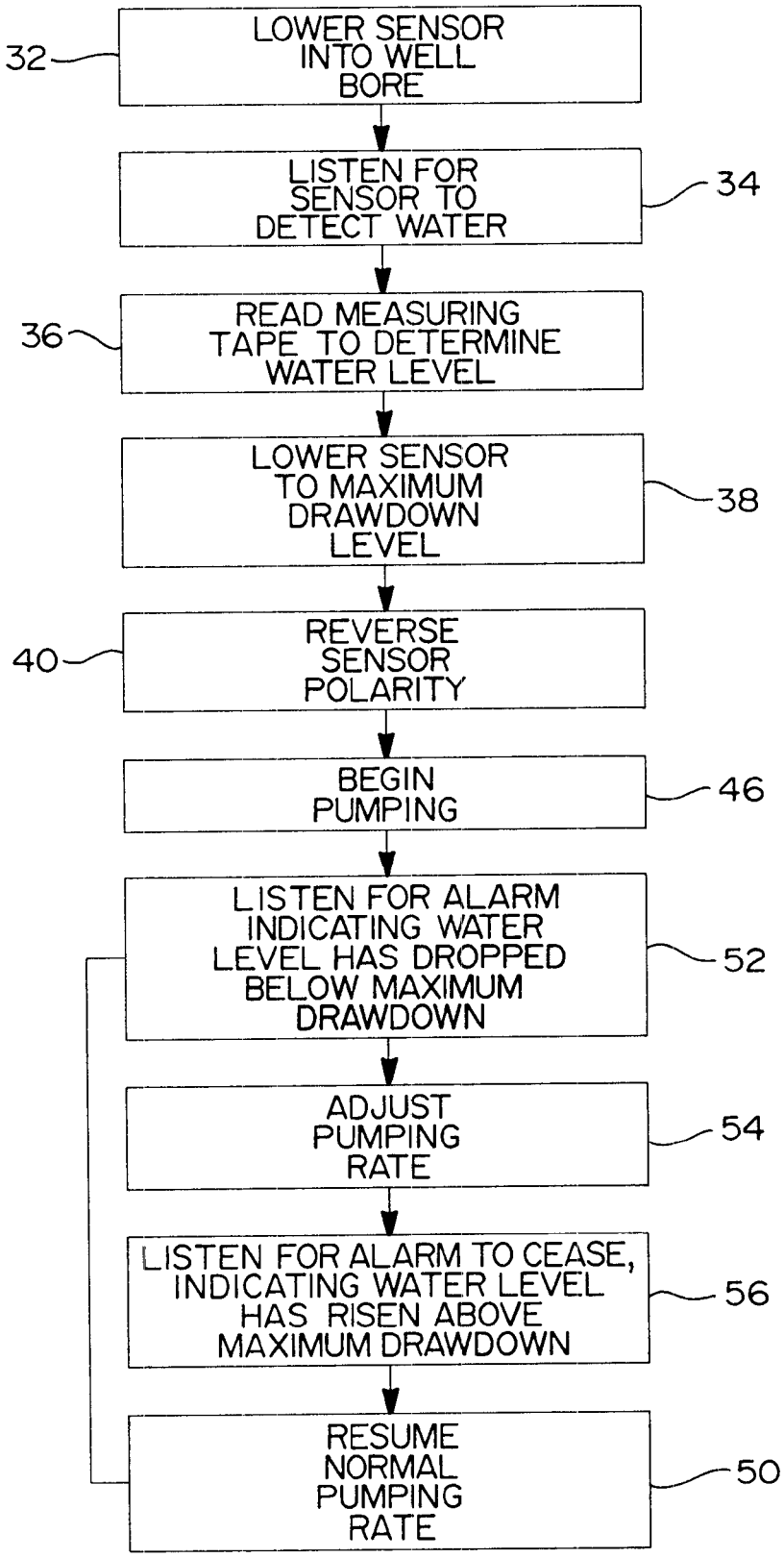
FIG. 4 is a flowchart of a method for sampling groundwater in accordance with an alternative preferred method of the present invention.

In another preferred embodiment of the present invention, the system 10 is used to control the proper pumping rate of a groundwater sampling pump 44. In a preferred embodiment, the sampling pump 44 is a portable sampling pump. With reference to FIG. 4, the user first determines the static water level 30 and maximum desired drawdown level 28 as in steps 32–38 described above. The user then reverses the polarity of the sensor by actuating the reverse sensor switch 26, as in step 40. As shown in step 46, the user then begins operating a suitable sampling pump. The flow rate of the sampling pump is controlled by the use of a controller 48. The flow rate is the rate at which fluid is discharged from the sampling pump 44. The controller 48 controls a valve of the sampling pump 44, which determines whether a pressurized fluid is injected into the sampling pump 44 or the sampling pump 44 is vented to atmosphere, in accordance with the usual operation of such a pump. In a preferred embodiment, the controller 48 is a portable controller.

As shown in step 52, the user monitors the display 20 while pumping. When the water level drops below the maximum desired drawdown level 28, the alarm is emitted. The user then adjusts the pumping rate to a lower pumping rate to avoid excessive drawdown, as shown in step 54. The user then waits for the alarm to cease, as shown in step 56, after which normal pumping is resumed, as shown in step 58.

Figure 5:
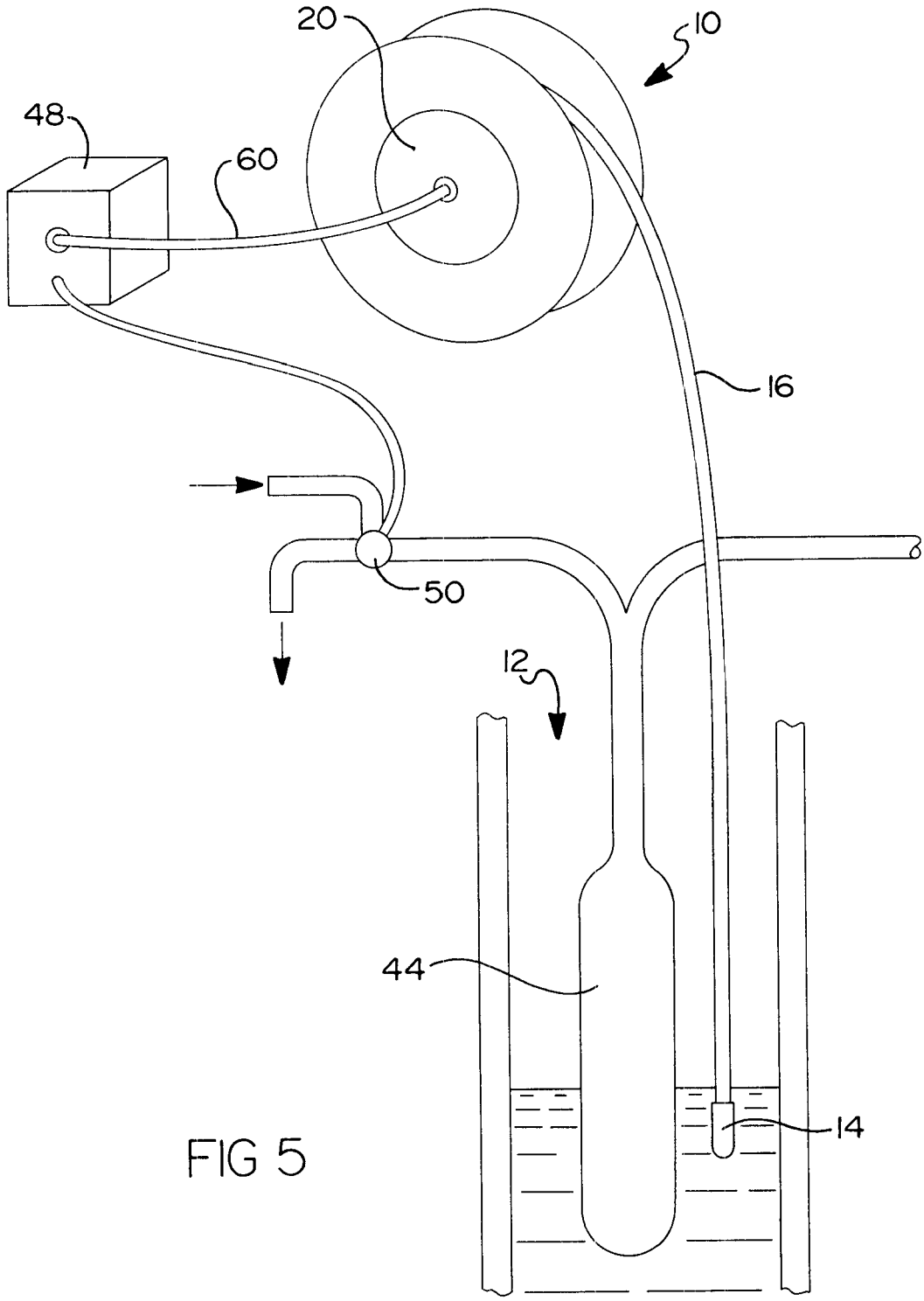
FIG. 5 is a cross-sectional view of a groundwater sampling apparatus in accordance with an alternative preferred embodiment of the present invention.

Referring to FIG. 5, in another preferred embodiment of the present invention the display 20 is directly connected to a pump controller 48 of a sampling pump 44 by a conductive cable 60, such that the alarm signal is directly propagated to the pump controller 48. The sampling pump 44 includes a valve 50 which is controlled by the controller 48 to either admit pressurized air into the pump 44 or to vent the interior area of the pump to atmosphere. Thus, when the sensor 14 senses an absence of water, the signal carrying that information is carried directly to the pump controller 48. The controller 48 then ceases pumping or automatically adjusts the pumping rate of the pump 44 to a lower pumping rate until the sensor 14 ceases to sense an absence of water. Thus, the pumping rate is automatically stopped or adjusted when the water level drops below the maximum desired drawdown level 28 and readjusted to the normal pumping rate when the water level rises above the maximum desired drawdown level 28.

The above described preferred embodiments have the important advantage that each reduces the amount of operator interaction required during measuring groundwater levels and taking groundwater samples by only alerting an operator when intervention is required, or alternately, by eliminating intervention almost entirely.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method of monitoring a fluid level of a fluid in a well bore, said method comprising the steps of:

determining a static fluid level by lowering a sensor into the well bore to a first depth, where the sensor emits an electrical signal when it comes into contact with the fluid;

lowering the sensor beyond the first depth to a second depth representing a maximum desired fluid drawdown level; and causing the sensor to generate a signal only when the sensor senses when it loses contact with the fluid thereby indicating when the maximum desired drawdown level has been exceeded.

2. The method of claim 1, wherein the step of determining the static fluid level includes the emission of at least one of an audible and visible alarm when the sensor senses the fluid.

3. The method of claim 1, wherein the step of using the sensor to determine only when the fluid has dropped below the second depth includes the emission of at least one of an audible and visible alarm when the sensor loses contact with the fluid.

4. The method of claim 1, further comprising the step of conducting a signal from the sensor to an alarm interface, wherein the signal is generated by the sensor when the sensor loses contact with the fluid.

5. The method of claim 4, further comprising the step of the alarm interface emitting at least one of an audible alarm and a visible alarm in response to the signal.

6. The method of claim 1, further comprising the step of adjusting the flow rate of a pump pumping the fluid from the well bore when the sensor loses contact with the fluid to prevent the maximum desired drawdown level from being exceeded.

7. The method of claim 6, wherein adjusting the pump includes reducing the flow rate of the pump.

8. The method of claim 7, wherein the pumping is stopped until the water level in the well bore rises above the maximum desired drawdown level.

9. A method of controlling a pump to avoid excessive drawdown of a fluid in a well bore, said method comprising the steps of:

determining a static fluid level of the fluid by lowering a sensor into the well bore to a first depth, where the sensor emits an electrical signal when it comes into contact with the fluid;

lowering the sensor into the well bore beyond the first depth to a depth representing a maximum desired drawdown level;

monitoring a fluid level in the well bore, wherein the sensor ceases emitting a signal when it loses contact with the fluid; and adjusting the operation of the pump in response to the sensor signal to avoid causing the fluid level in the well bore to drop below the maximum desired drawdown level.

10. The method of claim 9, further comprising the step of conducting the signal to an alarm interface, wherein at least one of an audible alarm and a visible alarm is emitted in response to the signal.

11. The method of claim 9, further comprising the step of conducting the signal to a controller for the pump, wherein the controller automatically adjusts the operation of the pump in response to the signal.

12. An apparatus for monitoring the level of a fluid in a well bore, said apparatus comprising:

a flexible element;

a sensor attached to the flexible element, the sensor emitting an electrical signal when it contacts a fluid in the well bore;

a controller;

a conductor for carrying an electrical signal from the sensor to the controller; and a reverse sensing switch on the controller, wherein engaging the switch causes the sensor to emit the electrical signal only when the sensor loses contact with the fluid.

13. The apparatus of claim 12, further comprising at least one of an audio or visual alarm connected to the sensor, wherein the at least one alarm is emitted when the sensor loses contact with the fluid.

14. The apparatus of claim 12, wherein the flexible member comprises a measuring tape.

15. The apparatus of claim 14, further comprising a rotating reel such that the tape can be wrapped around the reel for adjusting the depth of the sensor in the well bore.

16. The apparatus of claim 15, wherein the sensor controller is housed within the reel.

17. The apparatus of claim 12, further comprising a pump controller connected to the sensor controller, wherein the signal from the sensor is propagated to the pump controller such that the pump controller adjusts the operation of a pump to prevent the fluid from dropping below a predetermined maximum drawdown level.

18. A method of sampling groundwater, said method comprising the steps of:

determining a first static fluid level by lowering a sensor into the well bore, wherein the sensor emits an electrical signal when it comes in contact with the fluid;

further lowering the sensor beyond the static fluid level to a maximum desired drawdown level;

reconfiguring the sensor such that the sensor emits an electrical signal when it loses contact with the fluid;

monitoring the fluid level; and adjusting the operation of a pump in response to the electrical signal so as to prevent the fluid level from dropping below the maximum desired drawdown level.

19. The method of claim 18, wherein the step of adjusting the operation of the pump in response to the electrical signal includes propagating the electrical signal directly to a pump controller, wherein the pump controller automatically adjusts the operation of the pump in response to the electrical signal.

20. The method of claim 19, wherein the step of adjusting the operation of the pump includes the step of changing the pumping rate from a first pumping rate to a second, lower pumping rate in response to the signal indicating that the maximum desired drawdown level has been exceeded.

21. The method of claim 20, wherein the step of adjusting the operation of the pump includes the step of stopping the pumping until the water level rises above the maximum desired drawdown level.

22. The method of claim 20, further comprising the step of setting the pump to the first pumping rate when the fluid rises above the maximum desired drawdown level.

23. An apparatus for sampling groundwater in a well bore such that a fluid drawdown level in the well bore is not exceeded, the apparatus comprising:

a flexible element;

a sensor attached to the flexible element, wherein the sensor is lowered into the well bore using the flexible element, the sensor emitting an electrical signal only when it comes in contact with a fluid;

a portable sensor controller housed within a reel, the reel storing the portion of the flexible element not lowered into the well bore;

a conductor for carrying an electrical signal from the sensor to the sensor controller;

a reverse sensing switch on the controller, wherein engaging the switch causes the sensor to emit the electrical signal only when the sensor loses contact with the fluid;

a portable groundwater sampling pump; and a pump controller coupled to the sensor controller for adjusting the pumping rate of the pump from a first pumping rate to a second pumping rate slower than the then first pumping rate in response to the signal from the sensor, wherein the signal from the sensor indicates that the maximum desired drawdown level has been exceeded.

* * * * *